US011708679B2

(12) United States Patent
Tabata

(10) Patent No.: US 11,708,679 B2
(45) Date of Patent: Jul. 25, 2023

(54) CLT STRUCTURE

(71) Applicant: Sekisui House, LTD., Osaka (JP)

(72) Inventor: Osamu Tabata, Osaka (JP)

(73) Assignee: Sekisui House, LTD.

( * ) Notice: Subject to any disclaimer, the term of this patent is extended or adjusted under 35 U.S.C. 154(b) by 137 days.

(21) Appl. No.: 17/601,759

(22) PCT Filed: Mar. 31, 2020

(86) PCT No.: PCT/JP2020/014938
§ 371 (c)(1),
(2) Date: Oct. 6, 2021

(87) PCT Pub. No.: WO2020/209150
PCT Pub. Date: Oct. 15, 2020

(65) Prior Publication Data

US 2022/0195685 A1 Jun. 23, 2022

(30) Foreign Application Priority Data

Apr. 8, 2019 (JP) ..... 2019-073292

(51) Int. Cl.
*E02D 27/02* (2006.01)
*E04B 1/26* (2006.01)
(Continued)

(52) U.S. Cl.
CPC ..... *E02D 27/02* (2013.01); *E04B 1/26* (2013.01); *E04B 1/61* (2013.01); *E04B 2/56* (2013.01)

(58) Field of Classification Search
None
See application file for complete search history.

(56) References Cited

U.S. PATENT DOCUMENTS 6,032,431 A * 3/2000 Sugiyama ..... F16B 9/058 403/258
2011/0280649 A1* 11/2011 Dewson ..... E04B 1/26 403/171
2022/0195685 A1* 6/2022 Tabata ..... E04B 1/26

FOREIGN PATENT DOCUMENTS

JP 1975-027285 B 9/1975
JP 1982-156542 U 10/1982
(Continued)

*Primary Examiner* — Joshua K Ihezie
(74) *Attorney, Agent, or Firm* — Jordan and Koda, PLLC

(57) ABSTRACT

To provide a CLT structure in which an anchor member does not interfere with a reinforcement member. A CLT structure includes a strip footing having a reinforcing bar extending in a longitudinal direction, a wall panel which is a panel material obtained by laminating and bonding sawn boards and in which a slit extending along the longitudinal direction is formed in a lower end surface, joint plates each partly embedded in the strip footing and having a joint board section of a flat plate shape at least partly projecting upward from an upper surface of the strip footing, and drift pins connecting the joint board sections and the wall panel in an inserted state where the joint board sections projecting from the upper surface of the strip footing are inserted into the slit of the wall panel. The joint plate has the joint board section, a flange section embedded in the strip footing and extending in a direction crossing the perpendicular direction from the joint board section, and an anchor bolt embedded in the strip footing and extending downward from the flange section.

7 Claims, 10 Drawing Sheets

(51) Int. Cl.
*E04B 1/61* (2006.01)
*E04B 2/56* (2006.01)

(56) References Cited

FOREIGN PATENT DOCUMENTS

| | | | |
|---|---|---|---|
| JP | 1988-233133 | A | 9/1988 |
| JP | 1997-144132 | A | 6/1997 |
| JP | 2018-091138 | A | 6/2018 |
| JP | 2018-197474 | A | 12/2018 |

* cited by examiner

CLT STRUCTURE

BACKGROUND OF THE INVENTION

The present invention relates to a CLT structure in which a footing and a wall panel are joined.

Patent Literature 1 discloses a structure in which a footing and a CLT panel are joined. For the joint, a column base steel plate embedded in the footing, and drift pins passing through pin holes provided in the column base steel plate and the CLT panel are mainly used.

CITATION LIST

Patent Literature

Patent Literature 1: Japanese Patent Application Laid-Open No. 2018-197474

SUMMARY OF THE INVENTION

In the joint between the footing and the wall panel in the CLT structure, a joint member joining the footing and the wall panel is used to increase bearing strength of a joint portion in some cases. To the joint member, an anchor member is connected to resist pull-out force in some cases. The anchor member needs to have a certain length to obtain sufficient pull-out resistance.

In the footing, a reinforcement member is arranged along the longitudinal direction in the center in the width direction in some cases. When the joint member is similarly arranged along the longitudinal direction in the center in the width direction in the footing, the anchor member interferes with the reinforcement member when the anchor member extending downward from the joint member is long. When the anchor member is shortened to avoid the interference with the reinforcement member, there is a risk that sufficient pull-out resistance is not obtained in some cases. On the other hand, when the joint member is arranged to be offset from the center in the width direction of the footing, the joint member is also offset from the center in the width direction of the wall panel. This results in a risk of reducing strength of the wall panel and complicating processing of a slit to be formed in the wall panel in some cases.

The present invention has been made in view of the above-described circumstances. It is an object of the present invention to provide a means capable of arranging a reinforcement member of a footing and a joint plate at the same position in the width direction of the footing and causing no interference between an anchor member and the reinforcement member.

(1) A CLT structure according to the present invention includes: a footing formed of concrete and having a reinforcement member extending in a horizontal direction; a wall panel which is a panel material obtained by laminating and bonding sawn boards and in which a slit extending along a longitudinal direction is formed in a lower end surface; a joint plate partly embedded in the footing and having a joint board section of a flat plate shape at least partly projecting upward from an upper surface of the footing; and a connecting member connecting the joint board section and the wall panel in an inserted state where the joint board section projecting from the upper surface of the footing is inserted into the slit of the wall panel. The joint board section is positioned above the reinforcement member in an attitude in which a longitudinal direction of the joint board section lies along an extending direction of the reinforcement member.

The joint plate has the joint board section, a flange section embedded in the footing and extending in a direction crossing a perpendicular direction from the joint board section, and an anchor member embedded in the footing and extending downward from the flange section. The anchor member has a lower end positioned below the reinforcement member.

Since the anchor member extends downward from the flange section, the anchor member and the reinforcement member do not interfere even when the joint member is arranged upward along the reinforcement member.

(2) Preferably, the joint plates in a pair are combined such that the joint board sections are overlapped and the flange sections extend in opposite directions, and are embedded in the footing.

Since the flange sections extend in the opposite directions in the footing, pull-out resistance of the joint plates increases.

(3) Preferably, the anchor members are located at positions offset in opposite directions from a center in a longitudinal direction of the joint board sections.

Since the anchor members are positioned at the positions offset in the opposite directions with respect to the center in the longitudinal direction of the joint board sections, the pull-out resistance of the joint plates is hard to vary in the longitudinal direction.

(4) Preferably, the joint board section and the flange section are formed by bending a metal flat plate material having a rectangular outer shape into an L-shape in a cross section.

The joint plate can be easily manufactured.

(5) Preferably, the joint board section has a plurality of plate holes passing through the joint board section in a thickness direction of the joint board section. The wall panel has a plurality of panel holes passing through the wall panel in a thickness direction of the wall panel via the slit. The plurality of plate holes and the plurality of panel holes are arrangeable to overlap each other, and the connecting member is a pin inserted into the plate hole and the panel hole overlapping each other in the inserted state.

(6) Preferably, the plurality of plate holes is positioned in line symmetry with respect to a virtual line extending along the perpendicular direction through a center in the longitudinal direction of the joint board section.

When the joint board sections in a pair are combined, the plate holes are in an overlapped state.

(7) A spacer positioned between the footing and the wall panel is further provided.

The present invention provides a CLT structure in which, when a reinforcement member of a footing and a member joining the footing and a wall panel extend along a longitudinal direction at the same position in a width direction of the footing, an anchor member does not interfere with the reinforcement member.

DESCRIPTION OF EMBODIMENTS

Figure 1:
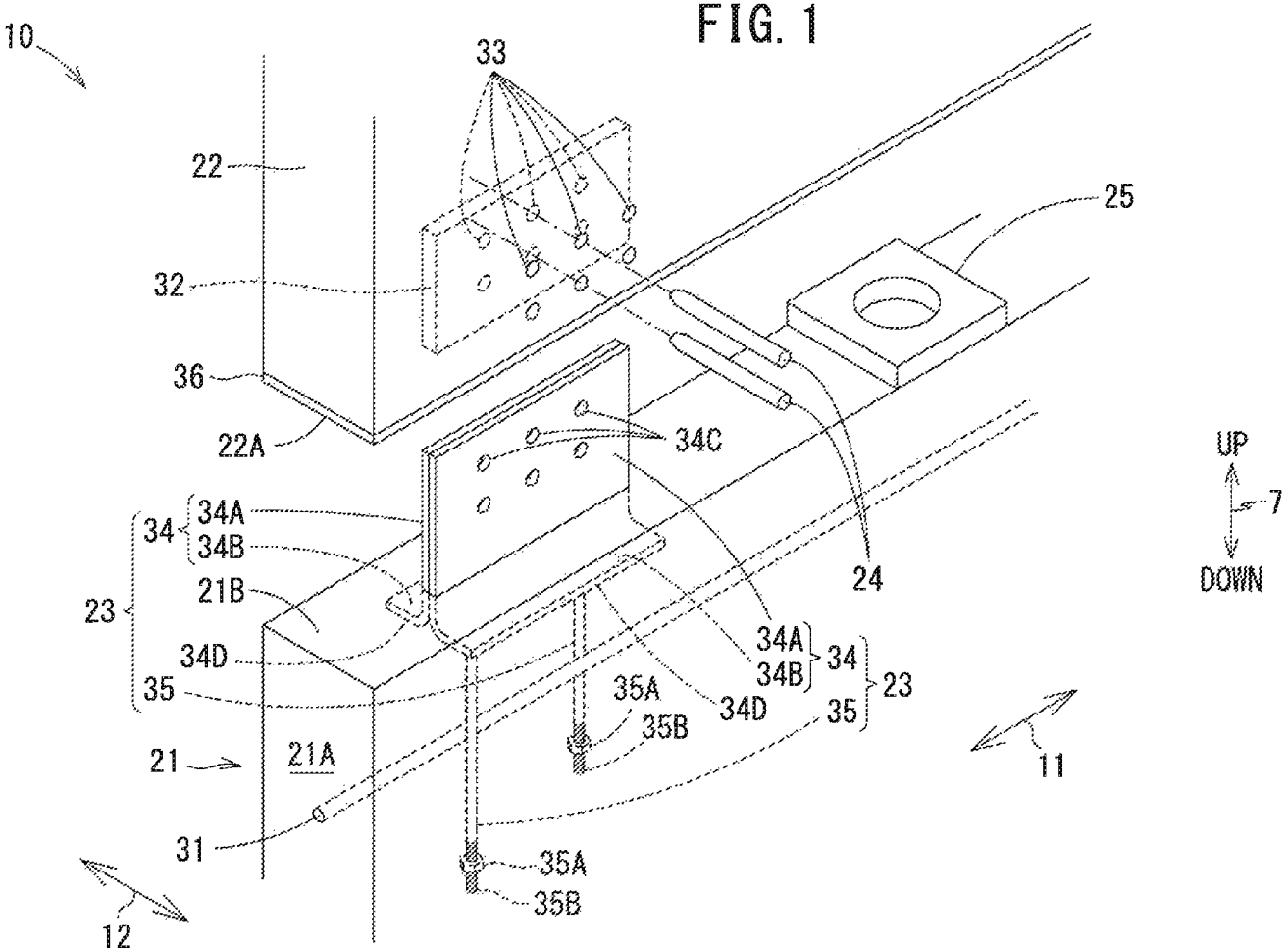
FIG. 1 is an exploded perspective view of a CLT structure 10 according to an embodiment.

Hereinafter, an embodiment of the present invention is described. It is a matter of course that the embodiment described below is merely an example of the present invention, and the embodiment of the present invention can be variously altered as appropriate without changing the gist of the present invention. In the following description, a vertical direction 7 is defined based on a state where a CLT structure 10 is installed to be usable (state in FIG. 1), a longitudinal direction 11 is defined as a direction in which a strip footing 21 and a wall panel 22 extend and a direction orthogonal to the vertical direction 7, and a width direction 12 is defined as the thickness direction of the strip footing 21 and the wall panel 22 and a direction orthogonal to both the vertical direction 7 and the longitudinal direction 11.

Figure 2:
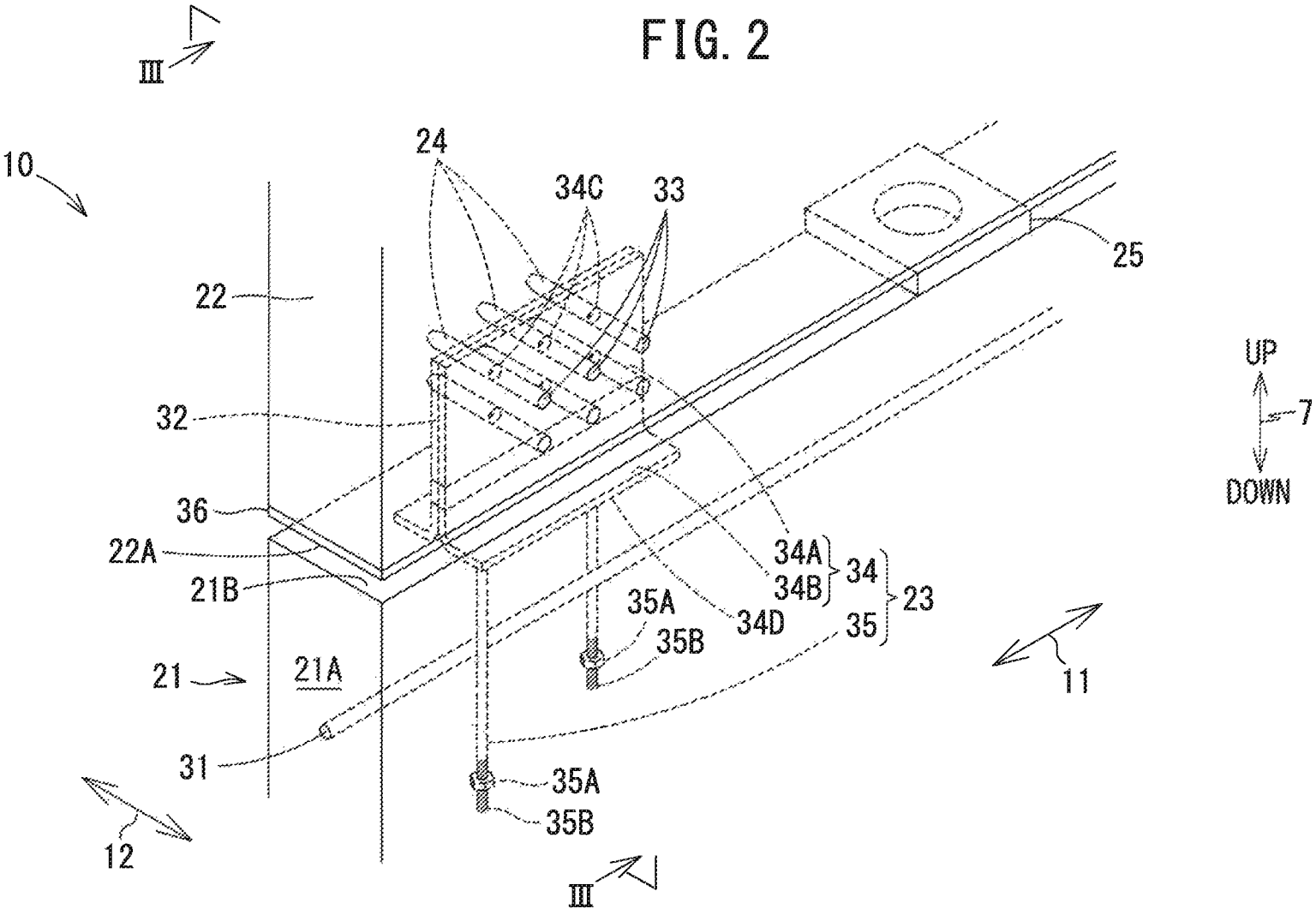
FIG. 2 is a perspective view of the CLT structure 10 according to the embodiment.

The CLT structure 10 of this embodiment is illustrated in FIG. 1 and FIG. 2. The CLT structure 10 is used as houses or condominiums. The CLT is an abbreviation for Cross Laminated Timber, and the same applies below.

The CLT structure 10 includes the strip footing 21, the wall panel 22, joint plates 23, drift pins 24, and a spacer 25 having air permeability.

The strip footing 21 is a footing used for houses or condominiums and is formed of concrete. On the strip footing 21, structural members of a building, such as the wall panel 22, are arranged. The strip footing 21 has, for example, a base section (not illustrated) having an inverted T-shaped cross-sectional structure and installed on the ground, and a raised section 21A projecting upward from an upper surface of the base section. Although the strip footing 21 is formed along at least the outer periphery of the CLT structure 10, only a part of the strip footing 21 is illustrated in this embodiment. Although to the strip footing 21, a plurality of the wall panels 22 are fixed via a plurality of the joint plates 23, only one wall panel is illustrated in this embodiment.

Figure 3:
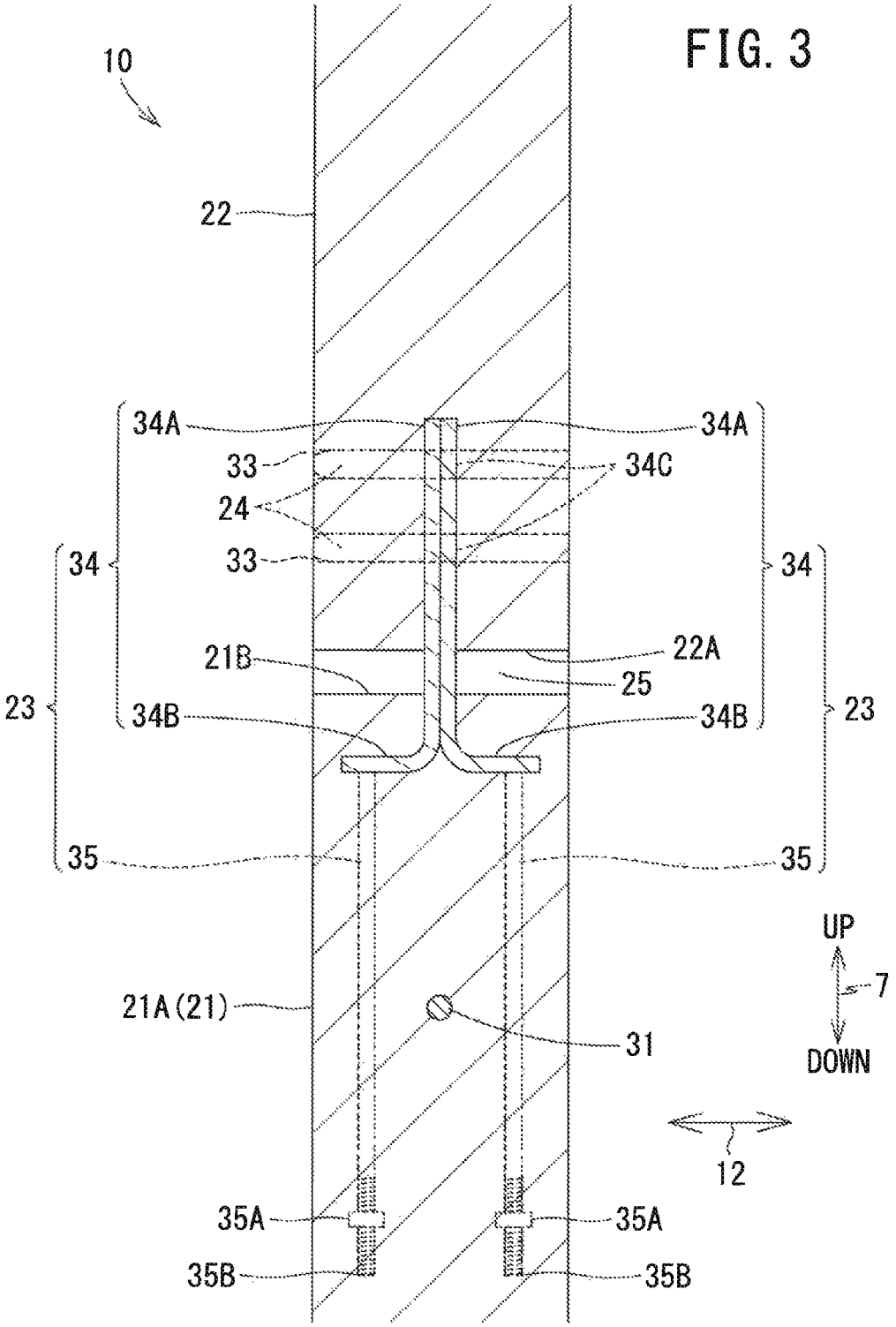
FIG. 3 is a III-III cross-sectional view in FIG. 2.

For the strip footing 21, a single reinforcement arrangement in which horizontal reinforcements are lined up along the vertical direction 7 in at least upper and lower two stages is used, for example. This reinforcement arrangement complements tensile strength of the strip footing 21. This reinforcement arrangement has a reinforcing bar 31 illustrated in FIG. 1 to FIG. 3. The reinforcing bar 31 is a horizontal reinforcement forming a part of the reinforcement arrangement and located at the uppermost position. The reinforcing bar 31 is positioned around the center in the width direction 12 of the raised section 21A as illustrated in FIG. 3. The reinforcing bar 31 horizontally extends along the longitudinal direction 11 in the raised section 21A. In FIG. 1 to FIG. 3, horizontal reinforcements and vertical reinforcements other than the reinforcing bar 31 are omitted.

The reinforcement arrangement including the reinforcing bar 31 is assembled at a predetermined place on the land, and then is embedded in the strip footing 21 by pouring, into a formwork, concrete which serves as the raised section 21A.

The wall panel 22 is formed by laminating sawn boards orthogonally to each other in each layer and bonding the sawn boards. The wall panel 22 having such a structure is commonly referred to as the CLT. The CLT structure 10 does not need pillars, and the wall panel 22 functions as a load-bearing wall. The size of the wall panel 22 is not limited, and the wall panel 22 has a flat plate shape with a vertical length of 3000 mm, a horizontal length of 2000 mm, and a thickness of 90 mm, for example.

As illustrated in FIG. 1 and FIG. 2, a slit 32 extending along the longitudinal direction 11 is formed in a lower end surface 22A of the wall panel 22. Into the slit 32, the joint plates 23 in a pair are fitted. The width in the width direction 12 of the slit 32 is substantially the same as the thickness of joint board sections 34A of the pair of joint plates 23. For example, the shape of the slit 32 is almost the same as the outer shape of a portion of the pair of the joint board sections 34A, the portion fitted into the slit 32, and is an elongated rectangle, for example. Although a plurality of the slits 32 may be formed in the lower end surface 22A of one wall panel 22, only one slit 32 is illustrated in this embodiment. Therefore, it is a matter of course that with respect to the joint plate 23 described below, although only one pair of joint plates 23 is illustrated corresponding to one slit 32, a plurality of sets of the joint plates 23 are embedded in the strip footing 21 corresponding to the number of the slits 32 of the plurality of wall panels 22.

The wall panel 22 has a plurality of panel holes 33 passing through the wall panel 22 in the width direction 12 via the slit 32. Into the panel holes 33, the drift pins 24 described later are inserted in a state where the pair of joint plates 23 is fitted into the slit 32 as illustrated in FIG. 2. As the plurality of panel holes 33, holes each having a diameter of 12.5 mm are provided at regular intervals in three vertical rows and in upper and lower two stages, for example. A plurality of plate holes 34C described later and the plurality of panel holes 33 are arranged to overlap each other in a state where the pair of joint plates 23 is inserted into the slit 32. The wall panel 22 is carried into a construction site after the slit 32 and the plurality of panel holes 33 are formed at a factory, for example.

A resin tape 36 may be stuck to edges of the end surfaces of the wall panel 22 for watertightness.

As illustrated in FIG. 1 to FIG. 3, the joint plates 23 are partly embedded in the strip footing 21 and are partly fitted into the slit 32 of the wall panel 22 with the pair of joint plates 23 as one set, thereby joining the strip footing 21 and the wall panel 22. With respect to the joint plate 23, rear surfaces 34E (see FIG. 4) of steel plates 34 of the two joint plates 23 are overlapped as illustrated in FIG. 5.

Figure 4:
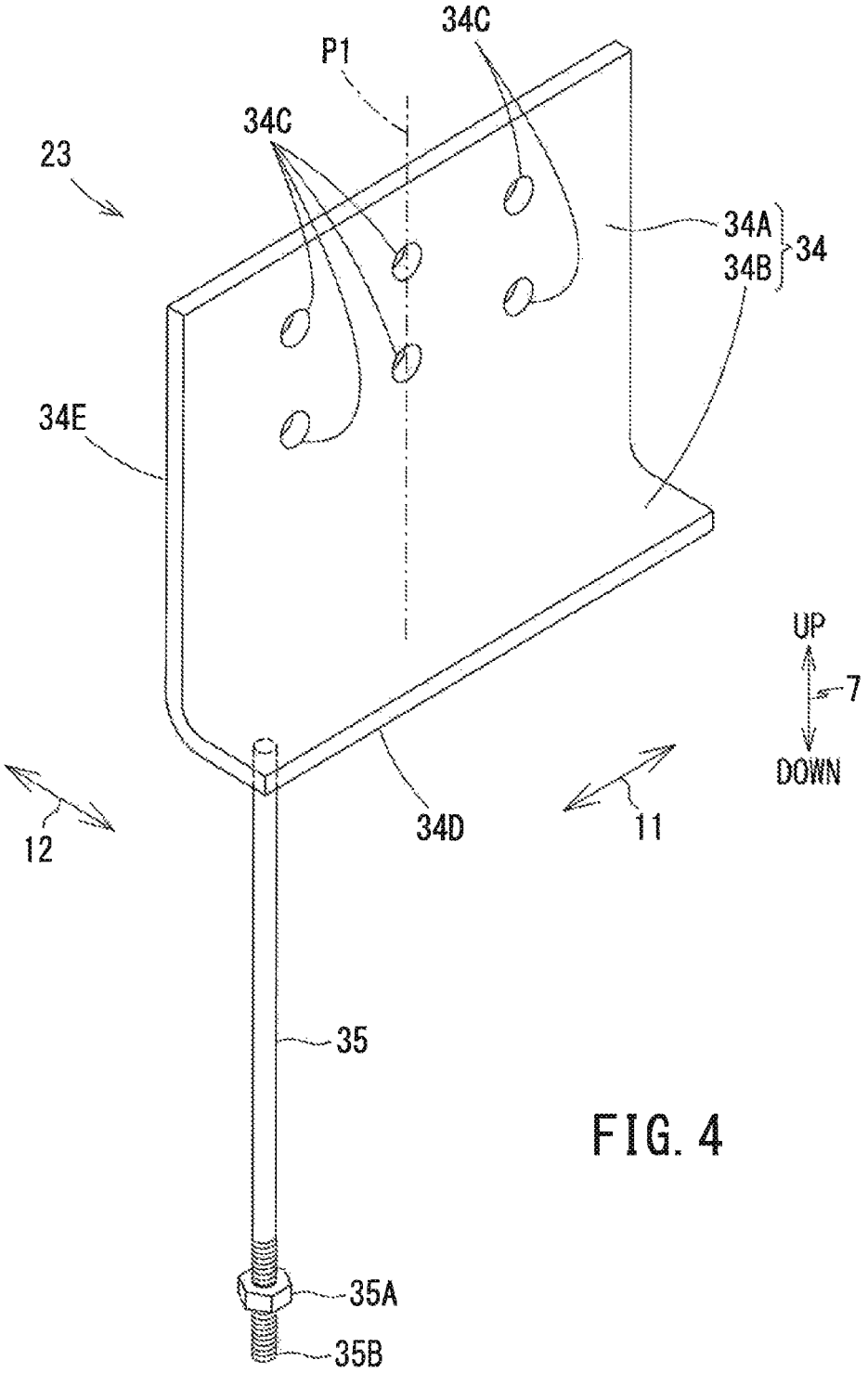
FIG. 4 is a perspective view of a joint plate 23 according to the embodiment.
Figure 5:
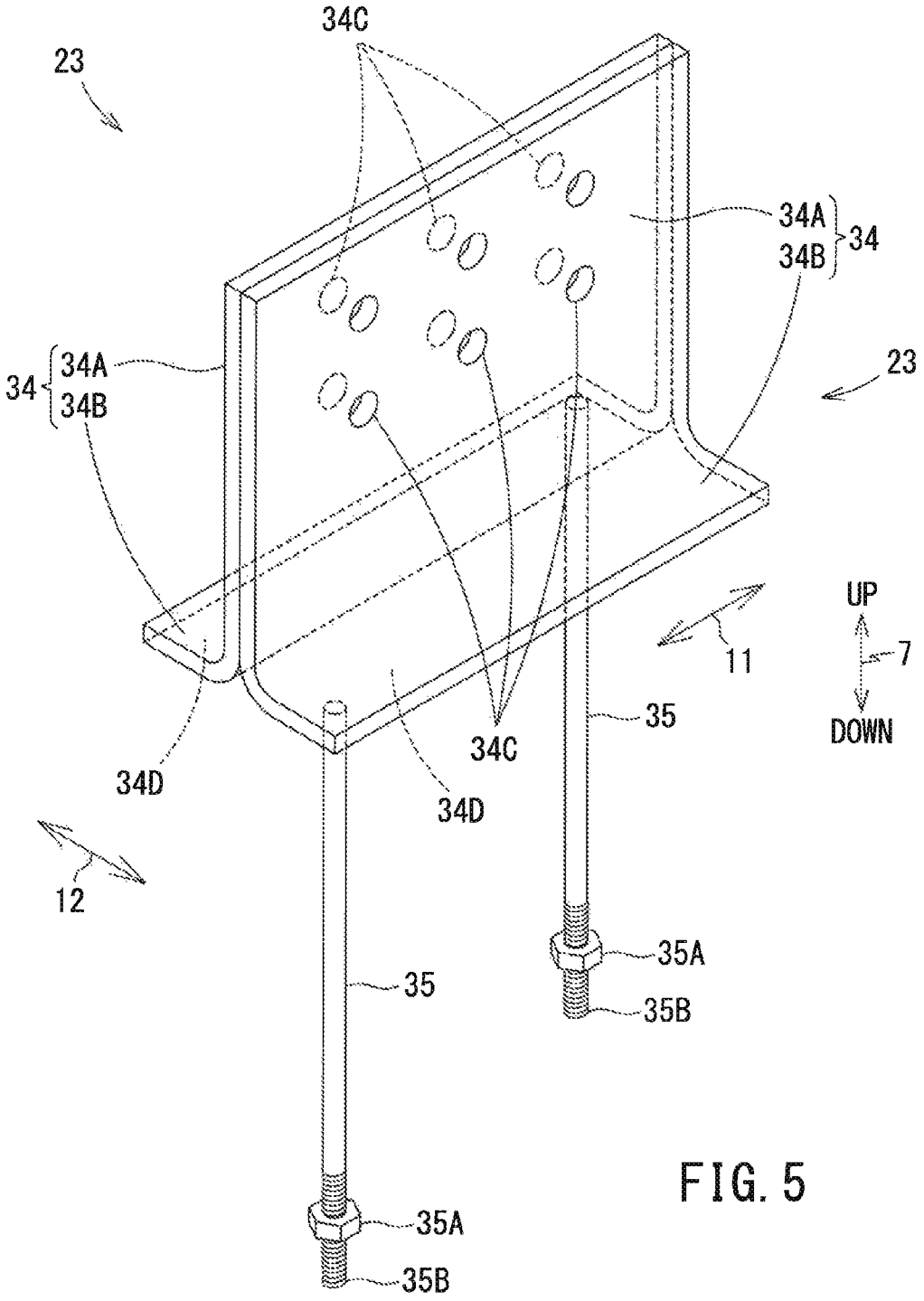
FIG. 5 is a perspective view of the joint plates 23 in a pair according to the embodiment.

As illustrated in FIG. 4 and FIG. 5, the joint plate 23 has the steel plate 34 and an anchor bolt 35. The steel plate 34 is an example of a metal flat plate material. The anchor bolt 35 is an example of an anchor member.

The steel plate 34 is formed by bending a steel plate having a rectangular outer shape and a constant thickness such that a longitudinal section along the vertical direction 7 has an L-shape. The steel plate 34 has the joint board section 34A of a flat plate shape and a flange section 34B of a flat plate shape. The joint board section 34A is a portion whose front and back surfaces expand in the longitudinal direction 11 and in the vertical direction 7 of the footing in a use state. The flange section 34B is a portion whose front and back surfaces expand in the longitudinal direction 11 and in the width direction 12 of the footing in the use state.

The joint board section 34A has the plurality of plate holes 34C passing through the joint board section 34A in the width direction 12. The plurality of plate holes 34C is positioned in line symmetry with respect to a virtual line P1 extending along the perpendicular direction through the center in the longitudinal direction 11 of the joint board section 34A. As the plurality of plate holes 34C, holes each having a diameter of 12.5 mm are provided at regular intervals in three vertical rows and in upper and lower two stages as with the panel holes 33, for example.

As illustrated in FIG. 4, the flange section 34B is connected to a lower end of the joint board section 34A. The size along the longitudinal direction 11 of the flange section 34B is the same as the size along the longitudinal direction 11 of the joint board section 34A. The anchor bolt 35 is welded to a lower surface 34D of the flange section 34B. The anchor bolt 35 is located at a position offset to one side in the longitudinal direction 11 with respect to the virtual line P1 in the lower surface 34D of the flange section 34B.

The anchor bolt 35 increases pull-out resistance of the joint plate 23 against the strip footing 21. As illustrated in FIG. 1 to FIG. 4, the anchor bolt 35 extends downward from the lower surface 34D of the flange section 34B. A male screw is formed in a lower end section of the anchor bolt 35 and a nut 35A is screwed into the male screw.

As illustrated in FIG. 5, the pair of joint plates 23 are combined such that the rear surfaces 34E of the steel plates 34 are caused to abut to have the same outer shape and the flange sections 34B extend in opposite directions in the width direction 12. In the pair of combined joint plates 23, the anchor bolts 35 are located at positions offset in opposite directions in the longitudinal direction 11 from the center in the longitudinal direction 11 of the joint board sections 34A, i.e., the virtual line P1. The plurality of plate holes 34C of the joint board sections 34A each are continuous in the width direction 12.

Hereinafter, an example of a construction method in which the joint plates 23 are partly embedded in the strip footing 21 is described. After the reinforcement arrangement of the strip footing 21 is assembled at a predetermined position and a formwork is provided and before concrete is poured into the formwork, the pair of joint plates 23 combined as illustrated in FIG. 5 is attached to a guide of an anchor ruler (not illustrated) attached to an upper end of the formwork. In the joint board sections 34A, the rear surfaces 34E are positioned in the center in the width direction 12 of the raised section 21A of the strip footing 21 and extend along the longitudinal direction 11. Therefore, the joint board sections 34A are positioned directly above the reinforcing bar 31.

As illustrated in FIG. 1 to FIG. 3, although the anchor bolts 35 have lower ends 35B positioned below the reinforcing bar 31, the anchor bolts 35 do not interfere with the reinforcing bar 31 because the anchor bolts 35 are located at positions offset in the opposite directions in the width direction 12 with respect to the center in the width direction 12 of the raised section 21A.

After the concrete is poured into the formwork to reach a predetermined position above the flange sections 34B and below the plate holes 34C of the joint board sections 34A and the concrete is hardened, the formwork and the anchor ruler are removed. Thus, the flange sections 34B and the anchor bolts 35 of the pair of joint plates 23 are embedded in the strip footing 21. In the joint board sections 34A, portions above the plate holes 34C project from an upper surface 21B of the strip footing 21 (see FIG. 1).

As illustrated in FIG. 2, the drift pins 24 connect the joint board sections 34A and the wall panel 22 in an inserted state where the pair of joint board sections 34A is inserted into the slit 32 of the wall panel 22. The drift pin 24 has a substantially columnar shape and has a diameter almost the same as the inside diameters of the plate hole 34C and the panel hole 33. The length of the drift pin 24 is almost the same as the thickness of the wall panel 22. The drift pins 24 are inserted into the plate holes 34C of the joint board sections 34A and the panel holes 33 of the wall panel 22 in the inserted state. Thus, the joint board sections 34A and the wall panel 22 are fixed. The drift pin 24 is an example of a pin.

The spacer 25 forms a space between the upper surface 21B of the strip footing 21 and the lower end surface 22A of the wall panel 22. The space formed by the spacer 25 ensures air permeability between the inside and the outside of the wall panel 22. As illustrated in FIG. 2 and FIG. 3, the spacer 25 has a flat plate shape having a size in the width direction 12 which is the same as the size in the width direction 12 of the upper surface 21B of the strip footing 21. Before the joint plates 23 are inserted into the slit 32 of the wall panel 22, a plurality of the spacers 25 are arranged on the strip footing 21 and the upper surface 21B where the joint plates 23 are not positioned.

Operational Effects of Embodiment

In this embodiment, the anchor bolt 35 extends downward from the flange section 34B extending along the width direction 12 from the joint board section 34A, and therefore even when the joint board section 34A is arranged upward along the reinforcing bar 31, the anchor bolt 35 and the reinforcing bar 31 do not interfere.

In the pair of combined joint plates 23, the flange sections 34B extend in the opposite directions with respect to the width direction 12 in the strip footing 21, and therefore the pull-out resistance of the joint plates 23 increases.

The anchor bolts 35 are positioned at the positions offset in the opposite directions with respect to the center in the longitudinal direction 11 of the pair of combined joint board sections 34A, and therefore the pull-out resistance of the joint plates 23 is hard to vary in the longitudinal direction 11.

The joint board section 34A and the flange section 34B are formed by bending a steel plate having a rectangular outer shape and a constant thickness such that the longitudinal section along the vertical direction 7 has the L-shape, and therefore the steel plate 34 can be easily manufactured.

The plurality of plate holes 34C is positioned in line symmetry with respect to the virtual line P1 extending along the perpendicular direction through the center in the longitudinal direction 11 of the joint board sections 34A. Therefore, when the pair of joint board sections 34A is combined, the plate holes 34C are in an overlapped state where the plate holes 34C each are continuous in the width direction 12.

The pair of joint plates 23 can be arranged in the center in the width direction 12 in the single reinforcement arrangement, and therefore pull-out resistance of the wall panel 22 in the width direction 12 does not vary. In this case, the slit 32 can be formed in the center in the width direction 12 in the wall panel 22, and therefore strength of the wall panel 22 does not vary.

Modification Example 1

Figure 6:
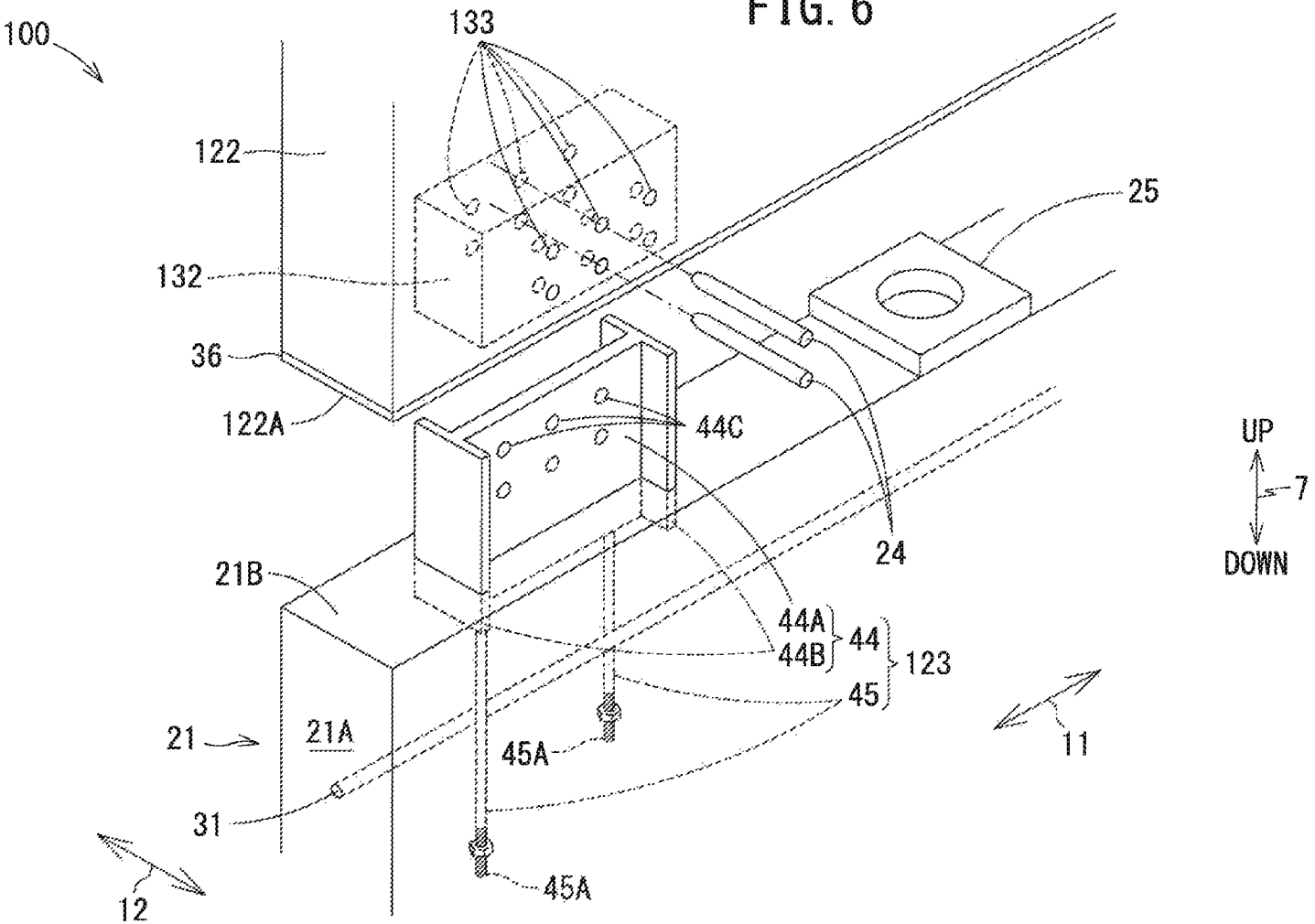
FIG. 6 is an exploded perspective view of a CLT structure 100 according to Modification Example 1.
Figure 7:
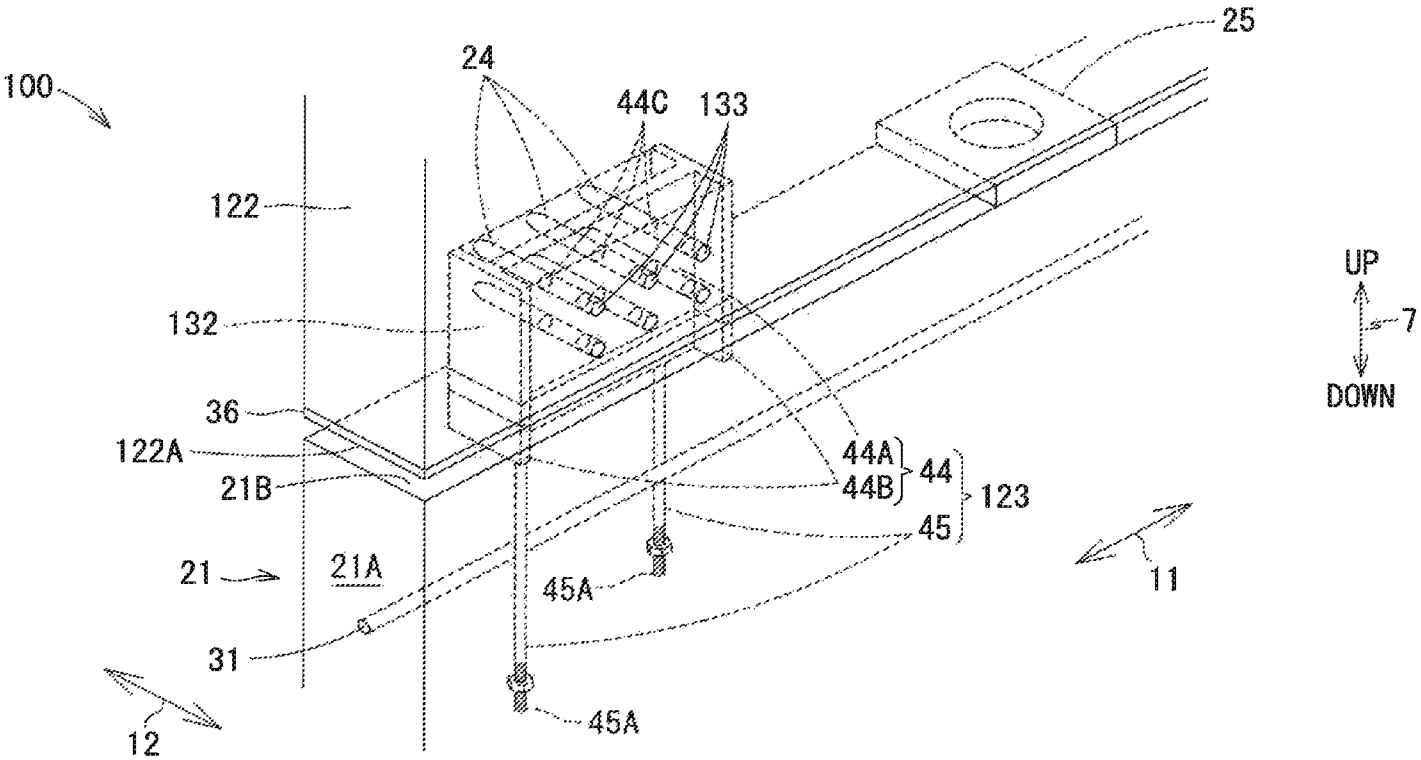
FIG. 7 is a perspective view of the CLT structure 100 according to Modification Example 1.
Figure 8:
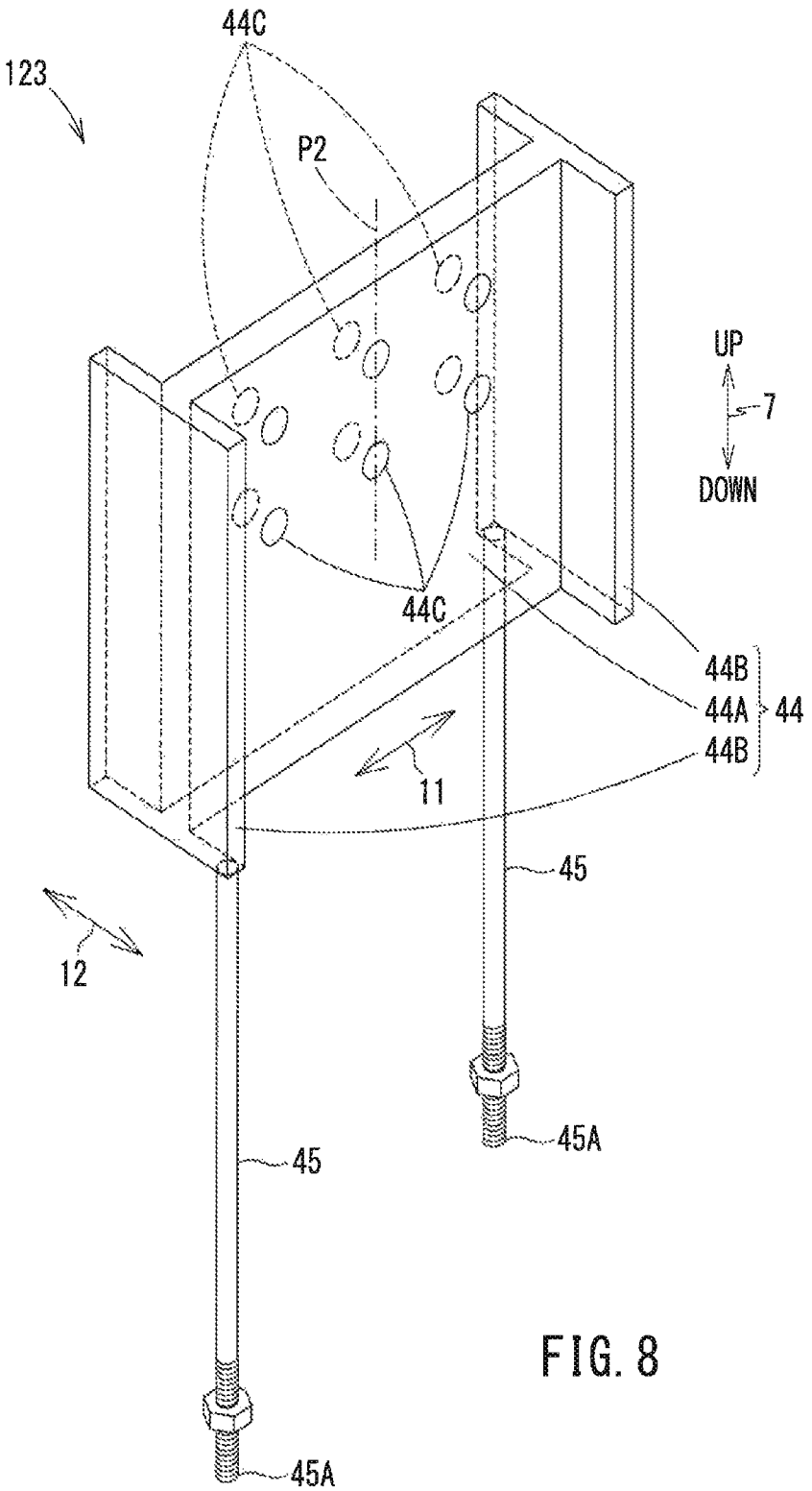
FIG. 8 is a perspective view of a joint plate 123 according to Modification Example 1.
Figure 9A:
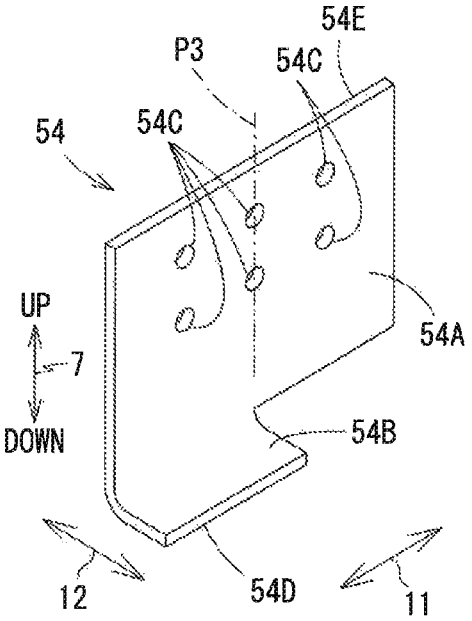
FIG. 9A is a perspective view of a steel plate 54 according to Modification Example 2.
Figure 9B:
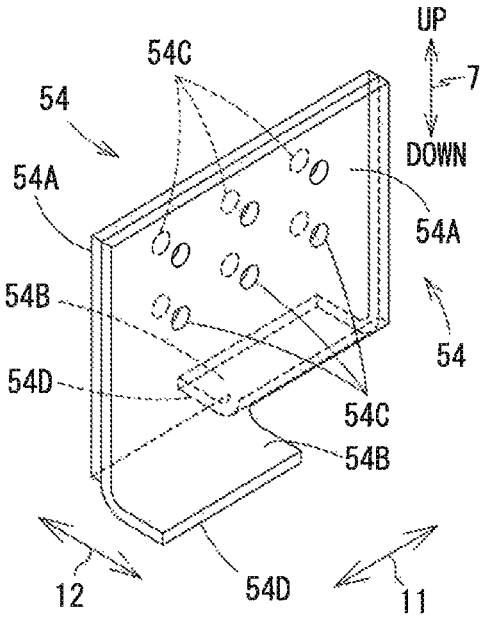
FIG. 9B is a perspective view of the steel plates 54 in a pair according to Modification Example 2.
Figure 9C:
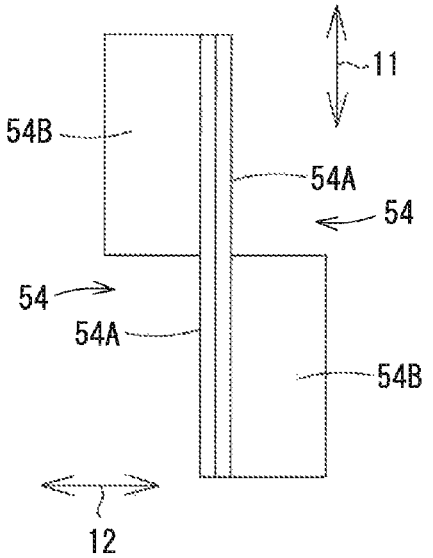
FIG. 9C is a plan view of the pair of steel plates 54 according to Modification Example 2.
Figure 9D:
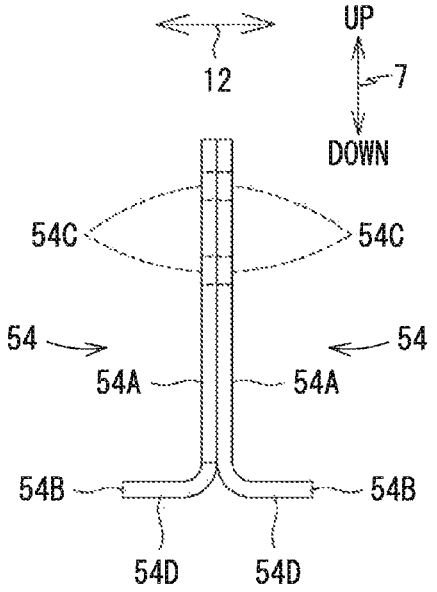
FIG. 9D is a side view of the pair of steel plates 54 according to Modification Example 2.

The above-described embodiment describes an example in which the joint plate 23 has the steel plate 34. However, the steel plate 34 may be an H-shaped steel 44 as illustrated in FIG. 6 to FIG. 8. Modification Example 1 describes an example of a CLT structure 100 in which a joint plate 123 having the H-shaped steel 44 is used.

The CLT structure 100 includes the strip footing 21, a wall panel 122, the joint plate 123, the plurality of drift pins 24, and the spacer 25 having air permeability.

As illustrated in FIG. 6 and FIG. 7, a slit 132 extending along the longitudinal direction 11 is formed in a lower end surface 122A of the wall panel 122. The width in the width direction 12 of the slit 132 is substantially the same as the width in the width direction 12 of flanges 44B of the joint plate 123. The shape of the slit 132 is a cuboid, for example.

The wall panel 122 has a plurality of panel holes 133 passing through the wall panel 122 in the width direction 12 via the slit 132. Into the panel holes 133, the drift pins 24 are inserted in a state where the joint plate 123 is fitted into the slit 132 as illustrated in FIG. 7. As the plurality of panel holes 133, holes each having a diameter of 12.5 mm are provided at regular intervals in three vertical rows and in upper and lower two stages, for example. A plurality of plate holes 44C described later and the plurality of panel holes 133 are arranged to overlap each other in a state where the joint plate 123 is inserted into the slit 132.

As illustrated in FIG. 6 and FIG. 7, the joint plate 123 is partly embedded in the strip footing 21 and is partly fitted into the slit 132 of the wall panel 122, thereby joining the strip footing 21 and the wall panel 122.

As illustrated in FIG. 6 to FIG. 8, the joint plate 123 has the H-shaped steel 44 and anchor bolts 45 connected to the H-shaped steel 44. The anchor bolt 45 is an example of an anchor member.

The H-shaped steel 44 has a joint board section 44A extending along the longitudinal direction 11 in the center in the width direction 12, and the flanges 44B in a pair extending along the width direction 12 at both ends of the joint board section 44A. The joint board section 44A is a portion whose front and back surfaces expand in the longitudinal direction 11 and in the vertical direction 7 of the strip footing 21 in the use state. The flange 44B is a portion whose front and back surfaces expand in the width direction 12 and in the vertical direction 7 of the strip footing 21 in the use state.

The joint board section 44A extends along the longitudinal direction 11 around the center in the width direction 12 as illustrated in FIG. 6 and FIG. 7.

The joint board section 44A has the plurality of plate holes 44C passing through the joint board section 44A in the width direction 12. The plurality of plate holes 44C is positioned in line symmetry with respect to a virtual line P2 extending along the perpendicular direction through the center in the longitudinal direction 11 of the joint board section 44A as illustrated in FIG. 8. As the plurality of plate holes 44C, holes each having a diameter of 12.5 mm are provided at regular intervals in three vertical rows and in upper and lower two stages as with the panel holes 133, for example.

As illustrated in FIG. 8, the flanges 44B are connected to both ends of the joint board section 44A in the longitudinal direction 11, and extend to both sides in the width direction 12 from both of the ends. The sizes along the width direction 12 of the pair of flanges 44B are the same to each other. The anchor bolts 45 are welded to lower ends of the flanges 44B. The anchor bolts 45 are located at the lower ends of the flanges 44B, and thus are located at positions offset to one side in the longitudinal direction 11 with respect to the virtual line P2.

Hereinafter, an example of a construction method in which the joint plate 23 is partly embedded in the strip footing 21 is described. After the reinforcement arrangement of the strip footing 21 is assembled at a predetermined position and a formwork is provided and before concrete is poured into the formwork, the joint plate 123 is attached to a guide of an anchor ruler (not illustrated) attached to an upper end of the formwork. The joint board section 44A is positioned in the center in the width direction 12 of the raised section 21A of the strip footing 21 and extends along the longitudinal direction 11. Therefore, the joint board section 44A is positioned directly above the reinforcing bar 31.

As illustrated in FIG. 6 and FIG. 7, although the anchor bolts 45 have lower ends 45A positioned below the reinforcing bar 31, the anchor bolts 45 do not interfere with the reinforcing bar 31 because the anchor bolts 45 are located at positions offset in opposite directions in the width direction 12 with respect to the center in the width direction 12 of the raised section 21A.

After the concrete is poured into the formwork to reach a predetermined position above a lower end of the joint board section 44A and below the plate holes 44C of the joint board section 44A and the concrete is hardened, the formwork and the anchor ruler are removed. Thus, a part of each flange 44B and the anchor bolts 45 of the joint plate 123 are embedded in the strip footing 21. In the joint board section 44A and the flanges 44B, portions above the plate holes 44C project upward from the upper surface 21B of the strip footing 21 (see FIG. 6).

Modification Example 2

The above-described embodiment describes an example in which the steel plate 34 is formed by bending a steel plate having a rectangular outer shape and a constant thickness such that the longitudinal section along the vertical direction 7 has an L-shape as illustrated in FIG. 4. However, the steel plate 34 maybe a steel plate 54 obtained by bending a steel plate having an L-shape in plan view as illustrated in FIGS. 9A to 9D. Modification Example 2 describes an example of the steel plate 54.

The steel plate 54 is formed by bending a steel plate having an L-shape in plan view. The steel plate 54 has a base section 54A of a flat plate shape and a flange section 54B of a flat plate shape. The steel plate 54 is bent at an end section of the flange section 54B, the end section connected to the base section 54A. A longitudinal section along the vertical direction 7 of the steel plate 54 at the position where the base section 54A and the flange section 54B are connected has an L-shape. The base section 54A is a portion whose front and back surfaces expand in the longitudinal direction 11 and in the vertical direction 7 of the strip footing 21 in the use state. The flange section 54B is a portion whose front and back surfaces expand in the longitudinal direction 11 and in the width direction 12 of the strip footing 21 in the use state. The steel plate 54 is an example of a metal flat plate material. The base section 54A is an example of a joint board section.

The base section 54A has a plurality of plate holes 54C passing through the base section 54A in the width direction 12. The plurality of plate holes 54C is positioned in line symmetry with respect to a virtual line P3 extending along the perpendicular direction through the center in the longitudinal direction 11 of the base section 54A. The plurality of plate holes 54C and the plurality of panel holes 33 are arranged to overlap each other in a state where the pair of joint plates are inserted into the slit 32. As the plurality of plate holes 54C, holes each having a diameter of 12.5 mm are provided at regular intervals in three vertical rows and in upper and lower two stages as with the panel holes 33, for example. The base section 54A projects upward from the upper surface 21B of the strip footing 21 including the plate holes 54C and is partly embedded in the strip footing 21.

The flange section 54B is connected to a half of a lower end in the longitudinal direction 11 of the base section 54A. The size along the longitudinal direction 11 of the flange section 54B is half of the size along the longitudinal direction 11 of the base section 54A. An anchor bolt (not illustrated) is welded to a lower surface 54D of the flange section 54B. The anchor bolt is located at a position offset in the longitudinal direction 11 with respect to the virtual line P3 in the lower surface 54D of the flange sections 54B.

The pair of joint plates is combined such that rear surfaces 54E of the steel plates 54 are caused to abut to have the same outer shape and the flange sections 54B extend in opposite directions in the width direction 12. In the pair of combined joint plates, the anchor bolts are located at positions offset in opposite directions in the longitudinal direction 11 from the center in the longitudinal direction 11 of the base sections 54A, i.e., the virtual line P3. The plurality of plate holes 54C of the base sections 54A each are continuous in the width direction 12.

Operational Effects of Modification Example 2

In Modification Example 2, the steel plate amount used for the steel plates 54 is smaller than that in the above-described embodiment, thus reducing the cost required for the steel plates 54.

The steel plate 54 can be easily bent because the length in the longitudinal direction 11 of the flange section 54B is shorter than that in the above-described embodiment.

Modification Example 3

The above-described embodiment describes an example in which the plurality of plate holes 34C is positioned in line symmetry with respect to the virtual line P1 extending along the perpendicular direction through the center in the longitudinal direction 11 of the joint board section 34A. However, the plurality of plate holes may not necessarily be positioned in line symmetry, and in place of the steel plate 34, a steel plate 64 and a steel plate 65 having a plurality of plate holes 64C or 65C, respectively, not positioned in line symmetry may be used. Modification Example 3 describes an example in which the steel plate 64 and the steel plate 65 are used.

Figure 10B:
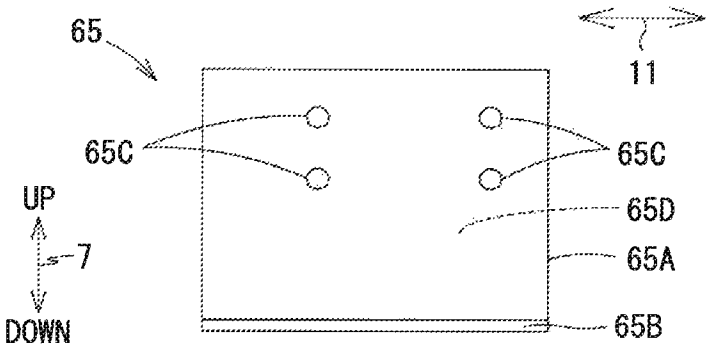
FIG. 10B is a front view of a steel plate 65 according to Modification Example 3.
Figure 10A:
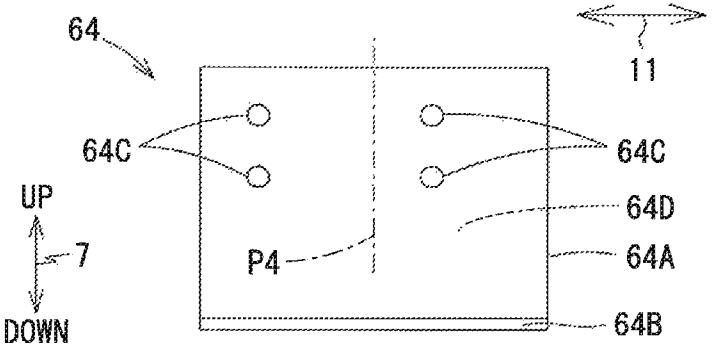
FIG. 10A is a front view of a steel plate 64 according to Modification Example 3.

As illustrated in FIG. 10A, the steel plate 64 is formed by bending a steel plate having a rectangular outer shape and a constant thickness such that the longitudinal section along the vertical direction 7 has an L-shape. The steel plate 64 has a joint board section 64A of a flat plate shape and a flange section 64B of a flat plate shape. The joint board section 64A is a portion whose front and back surfaces expand in the longitudinal direction 11 and in the vertical direction 7 of the strip footing 21 in the use state. The flange section 64B is a portion whose front and back surfaces expand in the longitudinal direction 11 and in the width direction 12 of the strip footing 21 in the use state. The joint board section 64A is provided with the plurality of plate holes 64C not positioned in line symmetry with respect to a virtual line P4 extending along the perpendicular direction through the center in the longitudinal direction 11 of the joint board sections 64A. The plurality of plate holes 64C passes through the joint board section 64A of the steel plate 64 in the width direction 12.

As illustrated in FIG. 10B, the steel plate 65 is formed in the same manner as the steel plate 64, and has a joint board section 65A of a flat plate shape and a flange section 65B of a flat plate shape. The joint board section 65A is provided with the plurality of plate holes 65C at positions, which are opposite to the positions of the plate holes 64C of the steel plate 64 in the longitudinal direction 11 and are the same as the positions of the plate holes 64C of the steel plate 64 in the vertical direction 7. The plurality of plate holes 65C passes through the joint board section 65A of the steel plate 65 in the width direction 12.

Figure 10C:
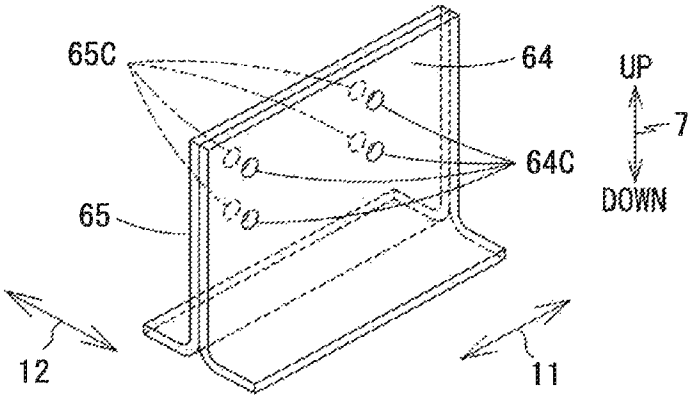
FIG. 10C is a perspective view in which the steel plate 64 and the steel plate 65 according to Modification Example 3 are overlapped.

As illustrated in FIG. 10C, the steel plate 64 and the steel plate 65 are combined such that rear surfaces 64D, 65D are caused to abut to have the same outer shape and the flange sections 64B, 65B extend in opposite directions in the width direction 12. The plurality of plate holes 64C, 65C of the joint board sections 64A, 65A, each are continuous in the width direction 12.

Other Modification Examples

Although the CLT structure 10 has the strip footing 21 in this embodiment, the CLT structure 10 may have a mat footing, without being limited thereto.

The reinforcing bar 31 may be one forming a part of a double reinforcement arrangement, located at the uppermost position, and located around the center in the width direction 12 of the raised section 21A.

The reinforcing bar 31 of the strip footing 21 may not necessarily be located in the center in the width direction 12 and may be one extending along the longitudinal direction 11 of the strip footing 21. A plurality of the reinforcing bars 31 may be provided, without being limited to one reinforcing bar 31. The reinforcement member is not limited to the reinforcing bar 31 and may be a rod, a cable, or the like in which carbon fibers, aramid fibers, or the like are used.

The shape of the width or the like in the width direction 12 of the slit 32 may not necessarily be the same as the outer shape of a portion fitted into the slit 32 of the joint board section 34A.

The pair of steel plates 34 may be one formed into an inverted T-shape by welding a lower end of one of two steel plates to the center in the width direction 12 of the other.

The depth in which the steel plate 34 is embedded in the strip footing 21 and the length in which the steel plate 34 projects from the upper surface 21B of the strip footing 21 may be determined according to strength and the like required in the CLT structure 10.

The number of the plate holes 34C and the number of the panel holes 33 are not limited to six as mainly illustrated in FIG. 1 and FIG. 2. The plate holes 34C and the panel holes 33 may not necessarily be arrangeable to entirely overlap each other and may be arrangeable to partly overlap each other.

The flange section 34B is not limited to one extending horizontally and may be one extending in a direction crossing the perpendicular direction.

The anchor bolt 35 is not limited to one illustrated in this embodiment and may be known anchors, bolts, or the like.

The anchor bolt 35 may be a bar material provided with a flange in place of one having a bolt shape with a male screw. Although the anchor bolt 35 has the upper end welded to the lower surface 34D of the flange section 34B in this embodiment, an upper end of the anchor bolt 35 may project from the upper surface of the flange section 34B and the projecting upper end may be tightened with a nut. The anchor bolt 35 may be fixed to the steel plate 34 at a factory or the like, and the anchor bolt 35 may be fixed to the steel plate 34 after carried into a construction site. When the anchor bolt 35 is fixed to the steel plate 34 after carried into the construction site, the anchor bolt 35 and the steel plate 34 are carried into the construction site in a separated state, thereby reducing bulkiness of the joint plate 23 during conveyance and enabling more efficient conveyance of the joint plate 23.

The number of the anchor bolts 35 is not limited to two and may be increased to three or more. The position where the additional anchor bolt 35 is connected to the flange section 34B is not limited to the end portion in the longitudinal direction 11 of the flange section 34B and may be located within a range of the flange section 34B.

Although the drift pins 24 are used in this embodiment, bolts and nuts may be used in place of the drift pins 24.

DESCRIPTION OF REFERENCE NUMERALS

10 CLT structure
11 longitudinal direction
12 width direction
21 strip footing (example of footing)
21B upper surface
22 wall panel
22A lower end surface
23 joint plate
24 drift pin (example of pin)
25 spacer
31 reinforcing bar (example of reinforcement member)
32 slit
33 panel hole
34A joint board section
34B flange section
34C plate hole
35 anchor bolt
35B lower end
44A joint board section
44B flange (example of flange section)
44C plate hole
45 anchor bolt
54A base section (example of joint board section)
54B flange section
54C plate hole
64A joint board section
64B flange section
64C plate hole
65A joint board section
65B flange section
65C plate hole
100 CLT structure
122 wall panel
122A lower end surface
123 joint plate
132 slit
P1, P2, P3, P4 virtual line

The invention claimed is:

1. A CLT (Cross Laminated Timber) structure comprising:
a footing formed of concrete and having a reinforcement member extending in a horizontal direction;
a wall panel which is a panel material obtained by laminating and bonding sawn boards and in which a slit extending along a longitudinal direction is formed in a lower end surface;
a joint plate partly embedded in the footing and having a joint board section of a flat plate shape at least partly projecting upward from an upper surface of the footing; and
a connecting member connecting the joint board section and the wall panel in an inserted state where the joint board section projecting from the upper surface of the footing is inserted into the slit of the wall panel, wherein
the joint board section is positioned above the reinforcement member in an attitude in which a longitudinal direction of the joint board section lies along an extending direction of the reinforcement member,
the joint plate has
the joint board section,
a flange section embedded in the footing and extending in a direction crossing a perpendicular direction from the joint board section, and
an anchor member embedded in the footing and extending downward from the flange section, and
the anchor member has a lower end positioned below the reinforcement member.

2. The CLT structure according to claim 1, wherein
the joint plate is one of a pair of joint plates that are combined such that the joint board sections are overlapped and the flange sections extend in opposite directions, and are embedded in the footing.

3. The CLT structure according to claim 2, wherein
the anchor members are located at positions offset in opposite directions from a center in a longitudinal direction of the joint board sections.

4. The CLT structure according to claim 1, wherein
the joint board section and the flange section are formed by bending a metal flat plate material having a rectangular outer shape into an L-shape in a cross section.

5. The CLT structure according to claim 1, wherein
the joint board section has a plurality of plate holes passing through the joint board section in a thickness direction of the joint board section,
the wall panel has a plurality of panel holes passing through the wall panel in a thickness direction of the wall panel via the slit,
the plurality of plate holes and the plurality of panel holes are arrangeable to overlap each other, and
the connecting member is a pin inserted into the plate hole and the panel hole overlapping each other in the inserted state.

6. The CLT structure according to claim 5, wherein
the plurality of plate holes is positioned in line symmetry with respect to a virtual line extending along the perpendicular direction through a center in the longitudinal direction of the joint board section.

7. The CLT structure according to claim 1, further comprising:
a spacer positioned between the footing and the wall panel.

* * * * *